US012590441B2

(12) United States Patent
Okamune et al.

(10) Patent No.: US 12,590,441 B2
(45) Date of Patent: Mar. 31, 2026

(54) WORK MACHINE, CONTROLLER FOR WORK MACHINE, AND METHOD OF CONTROLLING WORK MACHINE

(71) Applicant: KOMATSU LTD., Tokyo (JP)

(72) Inventors: Yuki Okamune, Tokyo (JP); Tsukasa Kitamura, Tokyo (JP); Akihiro Kyozu, Tokyo (JP); Takeshi Kamimae, Tokyo (JP)

(73) Assignee: KOMATSU LTD., Tokyo (JP)

( * ) Notice: Subject to any disclaimer, the term of this patent is extended or adjusted under 35 U.S.C. 154(b) by 186 days.

(21) Appl. No.: 18/036,448

(22) PCT Filed: Nov. 5, 2021

(86) PCT No.: PCT/JP2021/040694

§ 371 (c)(1),
(2) Date: May 11, 2023

(87) PCT Pub. No.: WO2022/123972

PCT Pub. Date: Jun. 16, 2022

(65) Prior Publication Data

US 2023/0417021 A1 Dec. 28, 2023

(30) Foreign Application Priority Data

Dec. 10, 2020 (JP) ..... 2020-204927

(51) Int. Cl.
*E02F 9/20* (2006.01)
*E02F 3/84* (2006.01)

(52) U.S. Cl.
CPC ..... *E02F 9/2083* (2013.01); *E02F 3/841* (2013.01)

(58) Field of Classification Search
CPC ..... E02F 9/2083; E02F 3/841; E02F 3/7636; B60T 13/662; B60T 7/12
See application file for complete search history.

(56) References Cited

U.S. PATENT DOCUMENTS

2005/0016320 A1* 1/2005 Porter ..... B60T 7/06 74/512
2005/0253542 A1 11/2005 Sugano et al.
(Continued)

FOREIGN PATENT DOCUMENTS

CN 101346264 A 1/2009
CN 107532409 A 1/2018
(Continued)

*Primary Examiner* — Vivek D Koppikar
*Assistant Examiner* — Godfrey Aleksander Maciorowski
(74) *Attorney, Agent, or Firm* — Faegre Drinker Biddle & Reath LLP

(57) ABSTRACT

A work machine is provided that can achieve an automatic brake retention function without hindering work. The work machine includes a vehicular body that travels, a work implement supported on the vehicular body, an accelerator operation device operated to increase a traveling speed of the vehicular body, a brake operation device operated to decrease the traveling speed of the vehicular body, and a controller. The controller performs automatic brake retention control to retain a braking force to maintain a travel-stopped state of the vehicular body when the traveling speed of the vehicular body becomes less than or equal to a threshold by operation of the brake operation device, and release the retention of the braking force by operation of the accelerator operation device. The controller determines whether work is being performed by the work implement, and when work is being performed, disables the automatic brake retention control.

7 Claims, 9 Drawing Sheets

(56) References Cited

U.S. PATENT DOCUMENTS

| | | | | |
|---|---|---|---|---|
| 2007/0186451 | A1 | 8/2007 | Yoshimatsu | |
| 2009/0013810 | A1 | 1/2009 | Nakagawa et al. | |
| 2009/0062982 | A1* | 3/2009 | Obata | B60Q 1/1484 701/36 |
| 2013/0256053 | A1 | 10/2013 | Shirao et al. | |
| 2013/0341133 | A1 | 12/2013 | Sano et al. | |
| 2014/0367187 | A1* | 12/2014 | Kodaka | B60T 1/062 180/338 |
| 2018/0119386 | A1 | 5/2018 | Kobayashi et al. | |

FOREIGN PATENT DOCUMENTS

| | | | |
|---|---|---|---|
| JP | S60-092117 | A | 5/1985 |
| JP | H08-142819 | A | 6/1996 |
| JP | H09-142270 | A | 6/1997 |
| JP | 2000-033859 | A | 2/2000 |
| JP | 2001-341624 | A | 12/2001 |
| JP | 2003-184808 | A | 7/2003 |
| JP | 2004-036304 | A | 2/2004 |
| JP | 2005-299102 | A | 10/2005 |
| JP | 2019-002233 | A | 1/2019 |
| WO | 2013/145337 | A1 | 10/2013 |

* cited by examiner

WORK MACHINE, CONTROLLER FOR WORK MACHINE, AND METHOD OF CONTROLLING WORK MACHINE

TECHNICAL FIELD

The present disclosure relates to a work machine, a controller for a work machine, and a method of controlling a work machine.

BACKGROUND ART

Japanese Patent Laying-Open No. 2000-33859 (PTL 1) discloses a stop brake device that includes switch means operable by a driver and brake retention means for retaining a braked state of a vehicle, wherein the stop brake device allows the brake retention means to operate when wheels are stopped and an operation state of the switch means is ON, and prohibits the brake retention means from operating when the operation state of the switch means is OFF.

CITATION LIST

Patent Literature

PTL 1: Japanese Patent Laying-Open No. 2000-33859

SUMMARY OF INVENTION

Technical Problem

In a work machine, such as a motor grader, that works while traveling, an automatic brake retention function is preferably used without affecting work.

The present disclosure proposes a work machine, a controller for a work machine, and a method of controlling a work machine that can achieve an automatic brake retention function without hindering work.

Solution to Problem

The present inventors have found that in application of an automatic brake retention function to a work machine, merely incorporating a function similar to that of a passenger car would be a factor that restrains work during travel at slow speed. The present inventors have further pursued their studies on smooth work even in a work machine with the automatic brake retention function, and contrived the following configuration.

According to the present disclosure, a work machine is proposed that includes a vehicular body that travels, a work implement supported on the vehicular body, an accelerator operation device operated to increase a traveling speed of the vehicular body, a brake operation device operated to decrease the traveling speed of the vehicular body, and a controller. The controller performs automatic brake retention control to retain a braking force to maintain a travel-stopped state of the vehicular body when the traveling speed of the vehicular body becomes less than or equal to a threshold by operation of the brake operation device, and release the retention of the braking force by operation of the accelerator operation device. The controller determines whether work is being performed by the work implement, and when work is being performed, disables the automatic brake retention control.

Advantageous Effects of Invention

According to the present disclosure, the automatic brake retention function of the work machine can be achieved without hindering work.

DESCRIPTION OF EMBODIMENTS

Figure 1:
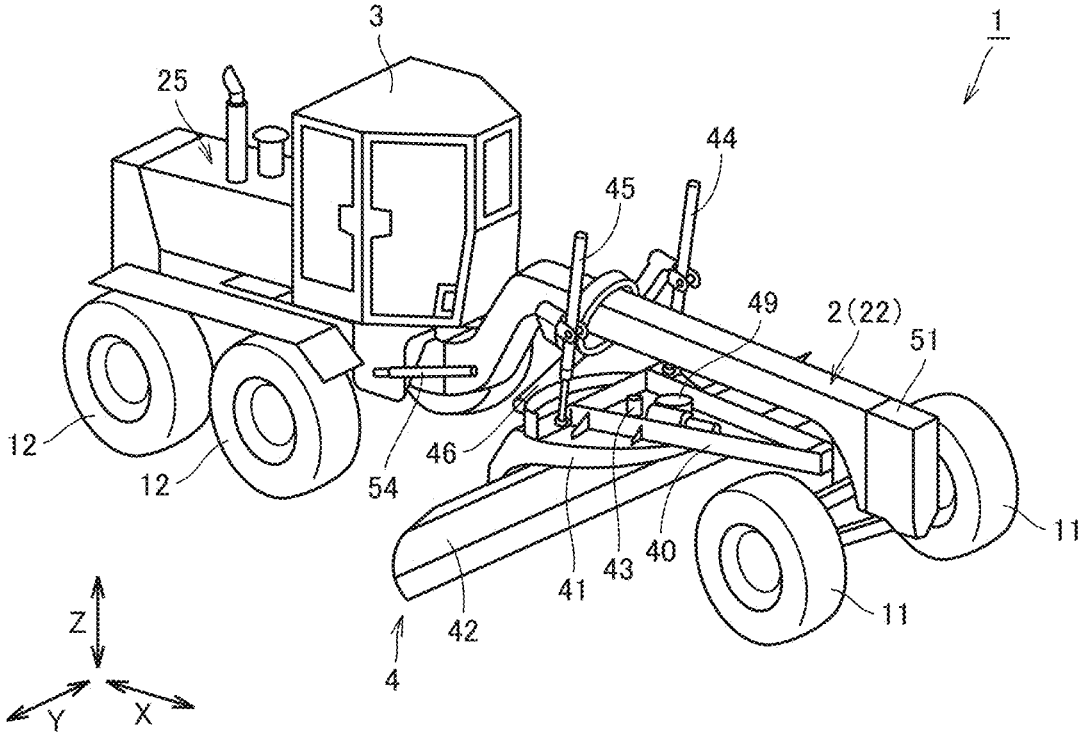
FIG. 1 is a perspective view schematically showing a construction of a motor grader based on an embodiment.

An embodiment will be described below with reference to the drawings. In the description below, the same elements have the same reference characters allotted and their labels and functions are also the same. Therefore, detailed description thereof will not be repeated.

Figure 2:
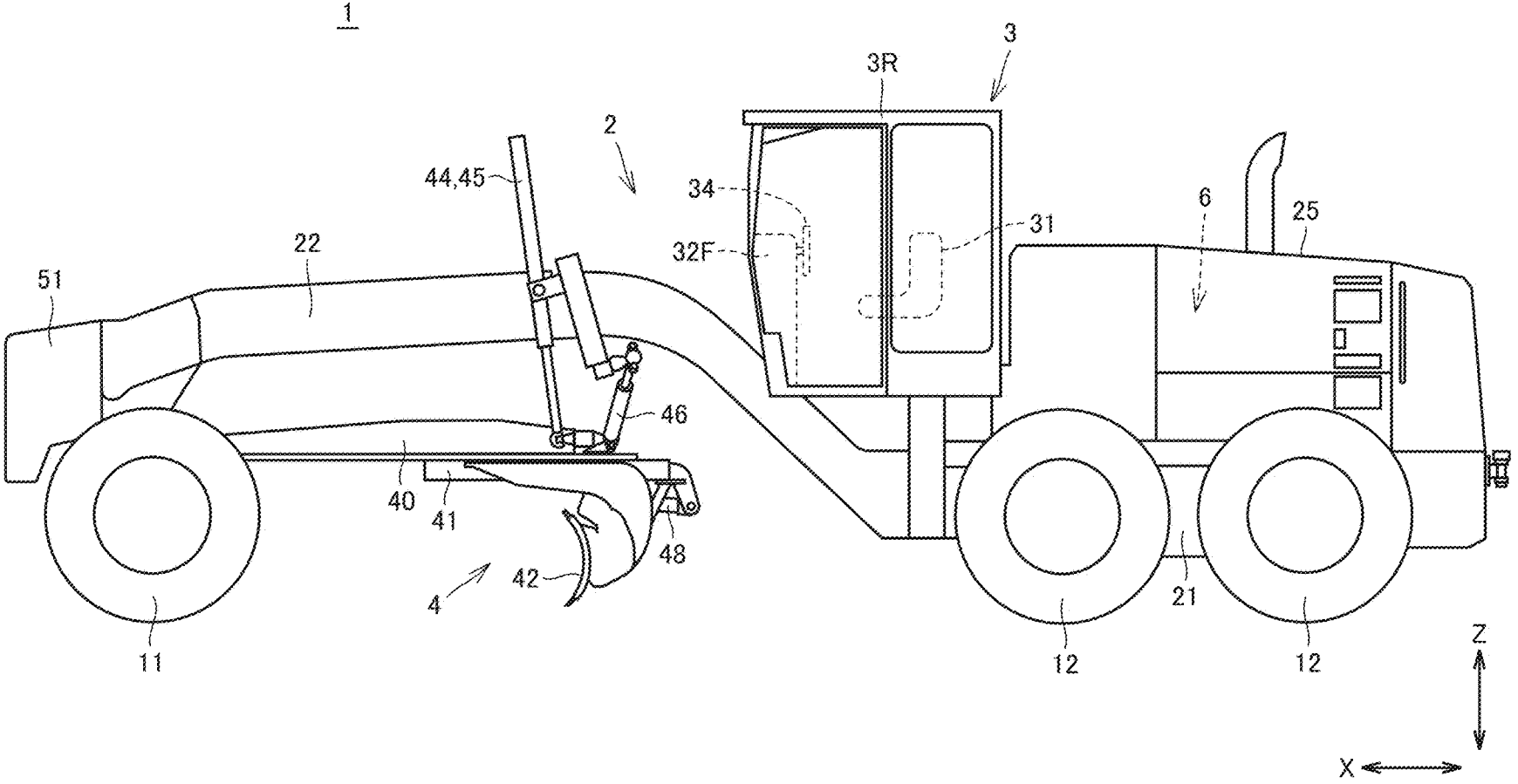
FIG. 2 is a side view of the motor grader shown in FIG. 1.

FIG. 1 is a perspective view schematically showing a construction of a motor grader 1 based on an embodiment. FIG. 2 is a side view of motor grader 1 shown in FIG. 1.

As shown in FIGS. 1 and 2, motor grader 1 based on the embodiment mainly includes a front wheel 11 which is a running wheel, a rear wheel 12 which is a running wheel, a vehicular body frame 2, a cab 3, and a work implement 4. Front wheel 11 includes one wheel on each of left and right sides. Rear wheel 12 includes two wheels on each of left and right sides. Though the figure shows six running wheels in total including two front wheels 11, one on each side, and four rear wheels 12, two on each side, the number and arrangement of front wheels and rear wheels are not limited as such.

Motor grader 1 includes components such as an engine arranged in an engine compartment 6. Work implement 4 includes a blade 42. Motor grader 1 can do such works as land-grading works, snow removal works, light cutting, and mixing of materials with blade 42.

In the description of the drawings below, a direction in which motor grader 1 travels in straight lines is referred to as a fore/aft direction of motor grader 1. In the fore/aft direction of motor grader 1, a side where front wheel 11 is arranged with respect to work implement 4 is defined as the fore direction. In the fore/aft direction of motor grader 1, a side where rear wheel 12 is arranged with respect to work implement 4 is defined as the rear direction. A lateral direction or a side of motor grader 1 is a direction orthogonal to the fore/aft direction in a plan view. A right side and a left side in the lateral direction in facing front are defined as a right direction and a left direction, respectively. An upward/ downward direction of motor grader 1 is a direction orthogonal to the plane defined by the fore/aft direction and the lateral direction. A side in the upward/downward direction where the ground is located is defined as a lower side and a side where the sky is located is defined as an upper side.

In the drawings, the fore/aft direction is shown with an arrow X in the drawings, the lateral direction is shown with an arrow Y in the drawings, and the upward/downward direction is shown with an arrow Z in the drawings.

Vehicular body frame 2 shown in FIGS. 1 and 2 extends in the fore/aft direction (a horizontal direction in FIG. 2). Vehicular body frame 2 includes a rear frame 21 and a front frame 22. Rear frame 21 is arranged in the rear of front frame 22. Rear frame 21 supports an exterior cover 25 and components such as an engine arranged in engine compartment 6. Exterior cover 25 covers engine compartment 6. For example, rear wheels 12, two on each side, are attached to rear frame 21. Each of four rear wheels 12 is rotationally drivable by a driving force from the engine.

Front frame 22 is arranged in front of rear frame 21. For example, front wheels 11, one on each side, are rotatably attached to front frame 22. Front frame 22 has a rear end coupled to a front end of rear frame 21 by a coupling shaft (not shown) arranged below cab 3 and extending in the upward-downward direction. Rear frame 21 is pivotably coupled to front frame 22.

Motor grader 1 can perform an articulation operation for pivoting front frame 22 with respect to rear frame 21 in the opposite directions. An articulation cylinder 54 is coupled between front frame 22 and rear frame 21. Front frame 22 pivots with respect to rear frame 21 as a result of extending and retracting of articulation cylinder 54 based on an operation from cab 3.

By pivoting (articulating) front frame 22 with respect to rear frame 21, a radius of revolution in revolution of motor grader 1 can be made smaller and a ditch digging work or a slope cutting work by offset running can be done. Offset running refers to linear travel of motor grader 1 by setting a direction of pivot of front frame 22 with respect to rear frame 21 and a direction of revolution of front wheel 11 with respect to front frame 22 to directions opposite to each other.

A counterweight 51 is attached to a front end of vehicular body frame 2. Counterweight 51 is an exemplary attachment attached to front frame 22. Counterweight 51 is attached to front frame 22 in order to increase downward load applied to front wheel 11 to enable steering and to increase pressing load onto blade 42.

Cab 3 is carried on front frame 22. Cab 3 includes an indoor space which an operator enters and it is arranged at the rear end of front frame 22. Cab 3 may be carried on rear frame 21.

An operator's seat 31 where the operator in cab 3 sits is arranged in cab 3. Operator's seat 31 is arranged substantially in the center of cab 3 in the fore/aft direction and the lateral direction. Cab 3 includes a roof portion 3R that covers operator's seat 31 from above and a plurality of pillars that support roof portion 3R. Roof portion 3R is arranged above operator's seat 31. Each pillar is coupled to a floor portion and roof portion 3R of cab 3.

Cab 3 has a highly rigid structure in conformity with a roll-over protective structure (ROPS) standardized as ISO 3471 and a falling-object protective structure (FOPS) standardized as ISO 3449. For protection of an operator in cab 3 even in the event of roll-over of motor grader 1 or falling of a falling object on cab 3, deformation of cab 3 is effectively suppressed.

Work implement 4 mainly includes a draw bar 40, a swing circle 41, blade 42, a swing motor 49, and various hydraulic cylinders.

Draw bar 40 is arranged below front frame 22. Draw bar 40 has a front end swingably coupled to a tip end portion of front frame 22 by a ball shaft portion. Draw bar 40 has a rear end supported on front frame 22 with a pair of lift cylinders 44 and 45 being interposed. As the pair of lift cylinders 44 and 45 extends and retracts in synchronization, the rear end of draw bar 40 can move up and down with respect to front frame 22. As lift cylinders 44 and 45 extend and retract differently from each other, draw bar 40 can swing up and down with an axis along a direction of travel of a vehicle being defined as the center.

A draw bar shift cylinder 46 is attached to front frame 22 and a side end of draw bar 40. As draw bar shift cylinder 46 extends and retracts, the rear end of draw bar 40 can move laterally with respect to front frame 22.

Swing circle 41 is arranged below front frame 22. Swing circle 41 is arranged below draw bar 40. Swing circle 41 is supported on the rear end of draw bar 40. Swing motor 49 is, for example, a hydraulic motor. Swing circle 41 can swingably be driven by swing motor 49 clockwise or counterclockwise with respect to draw bar 40 when viewed from above the vehicle. Swing circle 41 is rotatable relatively to draw bar 40. As swing circle 41 is swingably driven, an angle of inclination of blade 42 with respect to front frame 22 in a plan view is adjusted.

A swivel joint 43 is arranged at a center of swing of swing circle 41. A hydraulic pressure is sent from draw bar 40 to swing circle 41 with swivel joint 43 being interposed.

Blade 42 is supported on swing circle 41. Blade 42 is supported on front frame 22 with swing circle 41 and draw bar 40 being interposed.

A blade shift cylinder (not shown) is attached to swing circle 41 and blade 42 and arranged along a longitudinal direction of blade 42. With this blade shift cylinder, blade 42 is movable in the longitudinal direction thereof with respect to swing circle 41.

A tilt cylinder 48 is attached to swing circle 41 and blade 42. As a result of extending and retracting of tilt cylinder 48, blade 42 swings around the axis extending in the longitudinal direction thereof with respect to swing circle 41, and can change its orientation in the upward/downward direction. Tilt cylinder 48 can change an angle of inclination of blade 42 with respect to the direction of travel of the vehicle.

As set forth above, blade 42 is constructed to be able to move up and down with respect to the vehicle, swing around the axis along the direction of travel of the vehicle, change an angle of inclination with respect to the fore/aft direction, move in the longitudinal direction thereof, and swing around the axis extending in the longitudinal direction thereof, with draw bar 40 and swing circle 41 being interposed.

Figure 3:
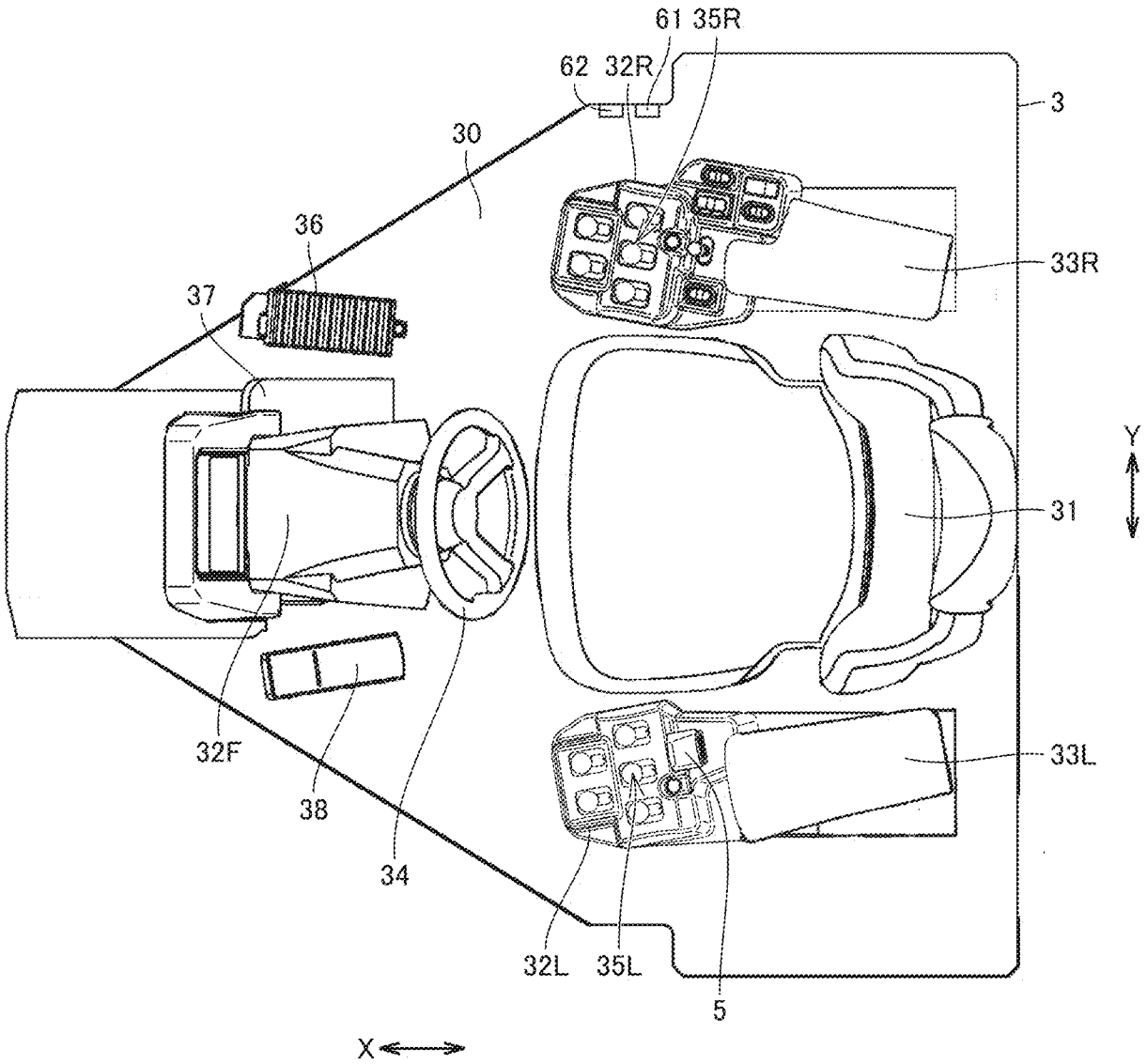
FIG. 3 is a plan view showing a construction inside a cab of the motor grader based on the embodiment.

FIG. 3 is a plan view showing a construction inside cab 3 of motor grader 1 based on the embodiment. Motor grader 1 mainly includes, in cab 3, a right console 32R, a left console 32L, operation levers, a right armrest 33R, a left armrest 33L, an accelerator pedal 36, and a brake pedal 37 in addition to operator's seat 31 and a steering wheel 34 also shown in FIG. 2.

The operator sits on operator's seat 31 and operates motor grader 1 while facing forward. Steering wheel 34 for the operator to control the direction of travel of motor grader 1 is arranged in front of operator's seat 31 in cab 3. Steering wheel 34 is attached to a steering console 32F and is supported on steering console 32F. The direction of front wheel 11 is changed as the operator rotates steering wheel 34, allowing motor grader 1 to change the direction of travel.

Right console 32R and left console 32L are each arranged lateral to operator's seat 31. Specifically, right console 32R is arranged to the right of operator's seat 31, and left console 32L is arranged to the left of operator's seat 31.

The operation lever is supported on the top of each of right console 32R and left console 32L. The operation lever is an electric lever. The operation lever supported on the top of right console 32R includes at least one work implement lever 35R. The operation lever supported on the top of left console 32L includes at least one work implement lever 35L and a steering control lever 5. Steering control lever 5 is arranged in the rear of work implement lever 35L.

Each of work implement levers 35L, 35R can be moved back and forth, for example, to be operated. Steering control lever 5 is, for example, a joystick lever. The direction in which steering control lever 5 is operated is a direction crossing (e.g., orthogonal to) the direction of operation of each of work implement levers 35L, 35R. Steering control lever 5 can be moved laterally, for example, to be controlled.

Work implement levers 35L, 35R correspond to a work implement operation unit of the embodiment for the operator to operate work implement 4. Steering control lever 5 is, similarly to steering wheel 34, used by the operator to control the direction of travel of motor grader 1. Steering wheel 34 and steering control lever 5 constitute a steering control unit of the embodiment. Steering control lever 5 is mainly used for steering while controlling work implement 4, that is, steering during work, and steering wheel 34 is mainly used for steering during non-work (non-working travel).

Right armrest 33R is arranged to the right of operator's seat 31. Right armrest 33R is a portion for the operator sitting on operator's seat 31 to place his/her right elbow. Left armrest 33L is arranged to the left of operator's seat 31. Left armrest 33L is a portion for the operator sitting on operator's seat 31 to place his/her left elbow. Each of right armrest 33R and left armrest 33L is located lateral to both of a seat portion and a backrest portion of operator's seat 31.

Right armrest 33R is arranged on right console 32R and is supported on right console 32R. Left armrest 33L is arranged on left console 32L and is supported on left console 32L.

Accelerator pedal 36, brake pedal 37, and a footrest 38 are arranged on a floor surface 30 of cab 3. As shown in FIG. 3, accelerator pedal 36 and brake pedal 37 are arranged to the right of steering console 32F. Footrest 38 is arranged to the left of steering console 32F.

Accelerator pedal 36 is an operation device that the operator steps on with his/her right foot to set the rotational speed of the engine to a desired rotational speed. Accelerator pedal 36 corresponds to an accelerator operation device according to the embodiment which is operated to increase the traveling speed of motor grader 1. Brake pedal 37 is an operation device that the operator steps on his/her right foot to apply brake force to rear wheel 12. Brake pedal 37 corresponds to a brake operation device according to the embodiment which is operated to decrease the traveling speed of motor grader 1. Footrest 38 is a support on which the operator places his/her left foot.

A work implement lock switch 61 and a brake retention switch 62 are attached to the inner wall of cab 3. Typically, work implement lock switch 61 and brake retention switch 62 are attached to the right pillar of a pair of left and right pillars (so-called B pillars) arranged at the center of cab 3 in the fore/aft direction. Work implement lock switch 61 and brake retention switch 62 may be provided in a switch box together with any other type of switch such as a switch for locking steering control lever 5, and the switch box may be attached to the right B pillar.

Work implement lock switch 61 is a switch operated by the operator to restrict an operation of work implement 4. When work implement lock switch 61 is turned on, control of an oil pressure supplied to a hydraulic actuator used for operating work implement 4 is restricted. As a result, the oil pressure supplied to the hydraulic actuator is not changed even when work implement levers 35L, 35R are operated, thus restricting the operation of work implement 4. Work implement lock switch 61 corresponds to a work implement lock device of the embodiment.

Motor grader 1 of the embodiment has an automatic brake retention function to retain a braking force to maintain a travel-stopped state when the traveling speed becomes equal to or less than a threshold by operation of brake pedal 37 performed by the operator, even if the operator takes his/her foot off brake pedal 37. The braking force is retained until the operator operates accelerator pedal 36. The retention of the braking force is released as the operator operates accelerator pedal 36.

Brake retention switch 62 is a switch operated by the operator to select whether to enable or disable the automatic brake retention function. When brake retention switch 62 is turned on, the automatic brake retention function is enabled. When brake retention switch 62 is turned off, the automatic brake retention function is disabled.

Brake retention switch 62 may be arranged on the right B pillar described above, as well as on right console 32R or in the vicinity of steering wheel 34. When brake retention switch 62 is arranged on the B pillar, the operator sitting on operator's seat 31 needs to reach out his/her hand to operate brake retention switch 62, and accordingly, such an arrangement is preferable to reduce or prevent erroneous operations of brake retention switch 62.

Figure 4:
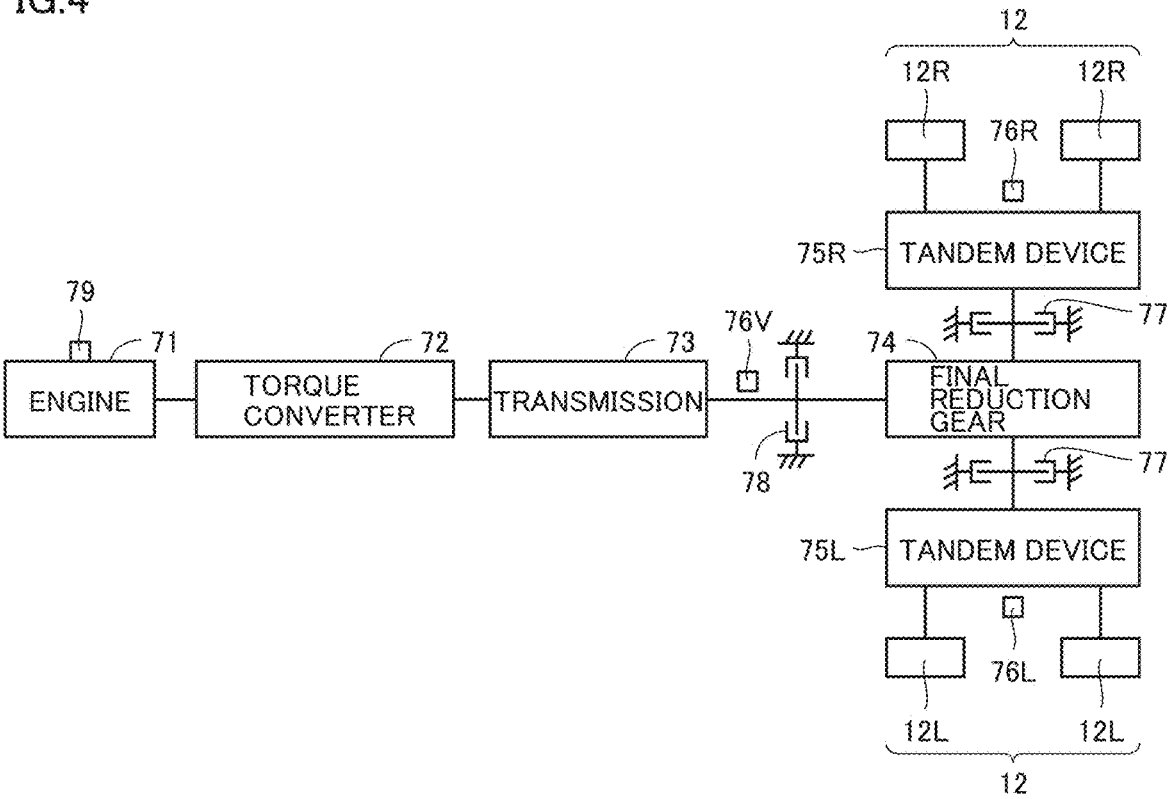
FIG. 4 is a diagram schematically showing a configuration regarding drive control of traveling wheels in the motor grader based on the embodiment.

FIG. 4 is a diagram schematically showing a configuration regarding drive control of traveling wheels in motor grader 1 based on the embodiment. Motor grader 1 of the embodiment is a rear-wheel-drive vehicle with rear wheel 12 as a driving wheel, to which the driving force of engine 71 is transmitted. Engine 71 is supported on rear frame 21. As an amount of fuel supplied to engine 71 is controlled according to the operation of accelerator pedal 36 by the operator, the rotational speed of engine 71 is controlled. The rotational speed of engine 71 is detected by engine speed sensor 79.

As shown in FIG. 4, a power transmission device for transmitting the driving force from engine 71 to rear wheel 12 includes a torque converter 72, a transmission 73, a final reduction gear 74, and tandem devices 75L, 75R.

Torque converter 72 is connected to the output side of engine 71. Torque converter 72 is a fluid clutch that transmits the driving force from engine 71 using oil as a medium. Torque converter 72 may be provided with a lock-up clutch that directly connects the input side and the output side of torque converter 72. Transmission of power via either the fluid clutch or the lock-up clutch may be switched by operator's selection.

Transmission 73 includes a plurality of clutches corresponding to a plurality of speed stages. Switching each clutch between a coupled state and an uncoupled state allows transmission 73 to switch the reduction gear ratio among a plurality of stages. A speed sensor 76V is provided on the output shaft of transmission 73. Speed sensor 76V detects the rotational speed of the output shaft of transmission 73.

Final reduction gear 74 is connected to the output shaft of transmission 73. The driving force output from transmission 73 is transmitted to left and right tandem devices 75L, 75R via final reduction gear 74. A pair of left rear wheels 12L are connected to left tandem device 75L. A pair of right rear wheels 12R are connected to right tandem device 75R. Engine 71 rotationally drives left rear wheels 12L and right rear wheels 12R via torque converter 72, transmission 73, final reduction gear 74, and tandem devices 75L, 75R.

Rotation speed sensor 76L detects the rotation speed of left rear wheel 12L. For example, rotation speed sensor 76L measures the rotation speed of the rotating shaft in tandem device 75L to measure the rotation speed of left rear wheel 12L. Rotation speed sensor 76R detects the rotation speed of right rear wheel 12R. For example, rotation speed sensor 76R measures the rotation speed of the rotating shaft in tandem device 75R to measure the rotation speed of right rear wheel 12R.

A parking brake 78 is provided on the output shaft of transmission 73. The parking brake is a brake used for maintaining the travel-stopped state of motor grader 1. Parking brake 78 is, for example, a negative type brake. As the operator operates the parking brake switch arranged in cab 3, parking brake 78 is switched between a braking state and a non-braking state. The parking brake switch may be provided on right console 32R. The parking brake switch may be provided in the rear of work implement lever 35R.

A service brake 77, which is driven by operation of brake pedal 37 by the operator, is provided between final reduction gear 74 and tandem device 75L, 75R. Service brake 77 is a brake used to decrease the traveling speed of motor grader 1 during travel. The braking force of service brake 77 is adjustable according to the amount of operation of brake pedal 37. Service brake 77 is, for example, a positive type brake.

Figure 5:
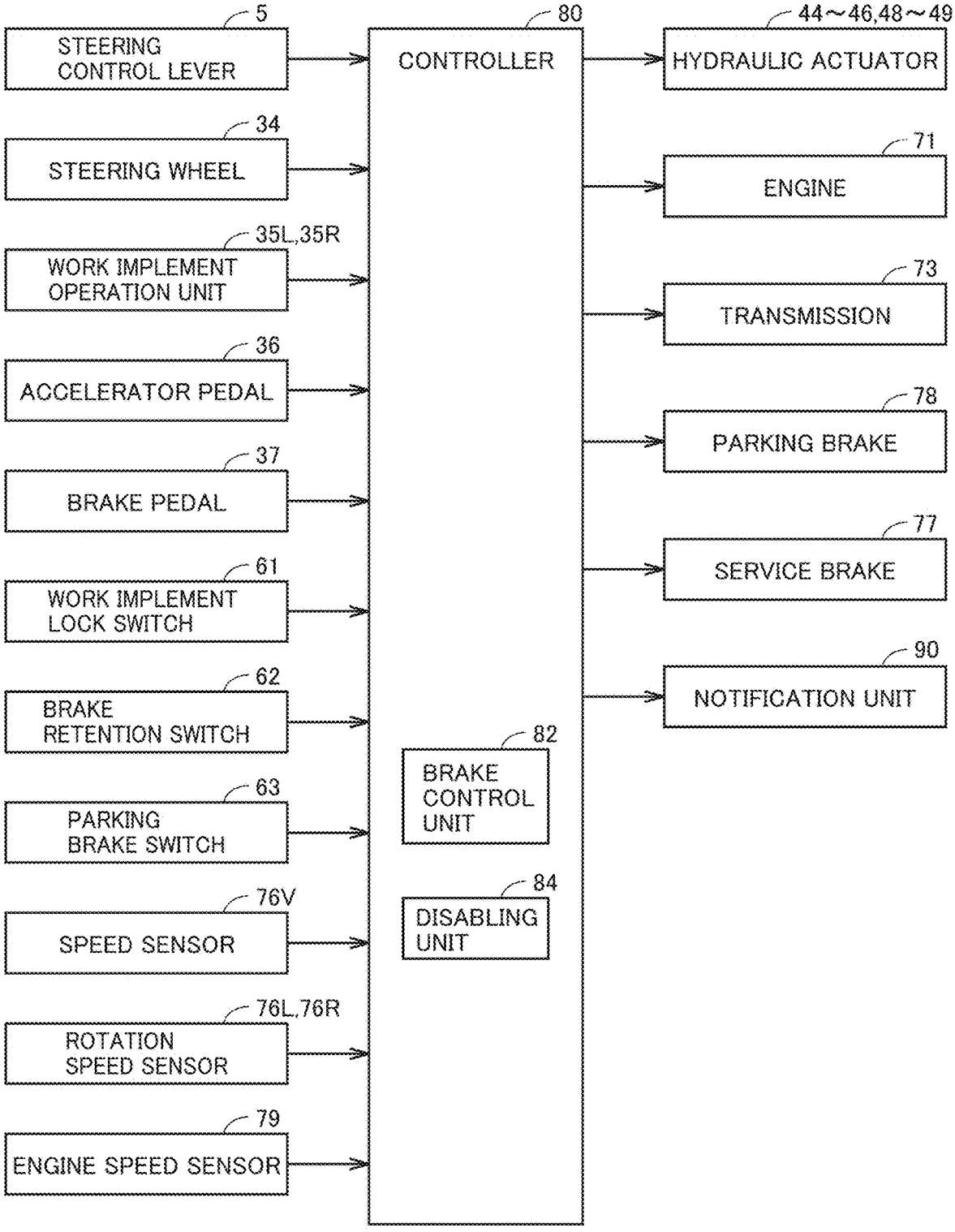
FIG. 5 is a block diagram showing a system configuration of the motor grader.

FIG. 5 is a block diagram showing a system configuration of motor grader 1. Motor grader 1 of the embodiment includes a controller 80. Controller 80 controls the operation of motor grader 1 as a whole, and is composed of a central processing unit (CPU), a nonvolatile memory, a timer, and the like.

Steering control lever 5 and steering wheel 34 that constitute the steering control unit, work implement levers 35L, 35R corresponding to the work implement operation unit, accelerator pedal 36, and brake pedal 37 are arranged in cab 3 and are operated by the operator sitting in cab 3. A sensor is provided that detects a direction of operation and an amount of operation of each of steering control lever 5, steering wheel 34, work implement levers 35L, 35R, accelerator pedal 36, and brake pedal 37. Detection signals detected by the sensors are input to controller 80.

Work implement lock switch 61, brake retention switch 62, and parking brake switch 63 are arranged in cab 3 and are operated by the operator sitting in cab 3. A sensor is provided that detects the state of operation of each of work implement lock switch 61, brake retention switch 62, and parking brake switch 63. Detection signals detected by the sensors are input to controller 80.

Speed sensor 76V detects the rotational speed of the output shaft of transmission 73 to detect a moving speed (a traveling speed of motor grader 1) during moving (during traveling) of motor grader 1. For example, speed sensor 76V may detect the moving speed of motor grader 1 with a global navigation satellite system (GNSS). Rotation speed sensors 76L, 76R detect the rotation speeds of left rear wheel 12L and right rear wheel 12R, respectively. Engine speed sensor 79 detects the rotational speed of engine 71. Detection signals detected by speed sensor 76V, rotation speed sensors 76L, 76R, and engine speed sensor 79 are input to controller 80.

Controller 80 includes a brake control unit 82. Brake control unit 82 performs automatic brake retention control. A threshold for the traveling speed of motor grader 1 is stored in a memory. While the setting for enabling the automatic brake retention function is set by operation of brake retention switch 62, brake control unit 82 retains the braking force to maintain the travel-stopped state of motor grader 1 when the traveling speed of motor grader 1 becomes less than or equal to the threshold by operation of brake pedal 37 performed by the operator. When accelerator pedal 36 is operated by the operator while the travel-stopped state of motor grader 1 is maintained, brake control unit 82 releases the retention of the braking force.

Controller 80 includes a disabling unit 84. Disabling unit 84 determines whether motor grader 1 is being worked by work implement 4. When motor grader 1 is being worked by work implement 4, disabling unit 84 disables the automatic brake retention control.

Controller 80 outputs a control signal for operating various hydraulic actuators, specifically, lift cylinders 44, 45, draw bar shift cylinder 46, tilt cylinder 48, and swing motor 49 in accordance with the operation of the work implement operation unit (work implement levers 35L, 35R) by the operator. As the hydraulic actuator is controlled, the operation of work implement 4 is controlled.

More specifically, motor grader 1 includes a hydraulic pump (not shown) that is driven upon receiving a driving force of engine 71, and a main valve (not shown), and is configured to allow a hydraulic oil discharged from the hydraulic pump to be supplied to the various hydraulic actuators via the main valve. The main valve is a spool type valve that moves a rod-shaped spool axially to adjust an amount of the hydraulic oil supplied to the hydraulic actuator. Controller 80 transmits a control signal for moving the spool of the main valve to the main valve. Thus, the operations of the various hydraulic actuators are controlled.

Controller 80 also outputs a control signal for locking work implement 4 in accordance with the operation of work implement lock switch 61 by the operator. Controller 80 stops the spool of the main valve to perform control such that an amount of the hydraulic oil supplied to the hydraulic actuator does not change, thus rendering work implement 4 locked so as not to operate even when the operator operates work implement levers 35L, 35R.

Controller 80 transmits, to engine 71 and transmission 73, a control signal according to the operation of the steering control unit and accelerator pedal 36 by the operator. As engine 71 and transmission 73 are controlled, the traveling operation of motor grader 1 is controlled.

Controller 80 transmits, to parking brake 78, a control signal according to the operation of parking brake switch 63 by the operator. As parking brake 78 is controlled, motor grader 1 is maintained in the travel-stopped state, or motor grader 1 is allowed to travel.

Controller 80 transmits, to service brake 77, a control signal according to the operation of brake pedal 37 by the operator. As service brake 77 operates, the traveling speed of motor grader 1 decreases.

Controller 80 transmits a control signal to notification unit 90. Notification unit 90 notifies the operator of the information about the state of operation of motor grader 1.

Notification unit 90 may include, for example, a work implement lock indicator lamp that lights up when work implement 4 is locked by operation of work implement lock switch 61 and goes out when work implement 4 is unlocked. Notification unit 90 may include, for example, an automatic brake retention indicator lamp that lights up when the automatic brake retention function is enabled by operation of brake retention switch 62 and goes out when the automatic brake retention function is disabled.

The work implement lock indicator lamp and the automatic brake retention indicator lamp may be provided in work implement lock switch 61 and brake retention switch 62, respectively. Alternatively, notification unit 90 may include a monitor, and the work implement lock indicator lamp and the automatic brake retention indicator lamp may be displayed on the monitor. When the work implement lock indicator lamp and the automatic brake retention indicator lamp light up, a pop-up display may appear on the monitor.

Information about the vehicular body, such as the traveling speed, the amount of remaining fuel, and the temperature of the hydraulic oil of motor grader 1 may be displayed on the monitor. When motor grader 1 includes an imaging device, such as a rear view camera for visual confirmation of the rear of the vehicular body, an image taken by the imaging device may be displayed on the monitor.

Figure 6:
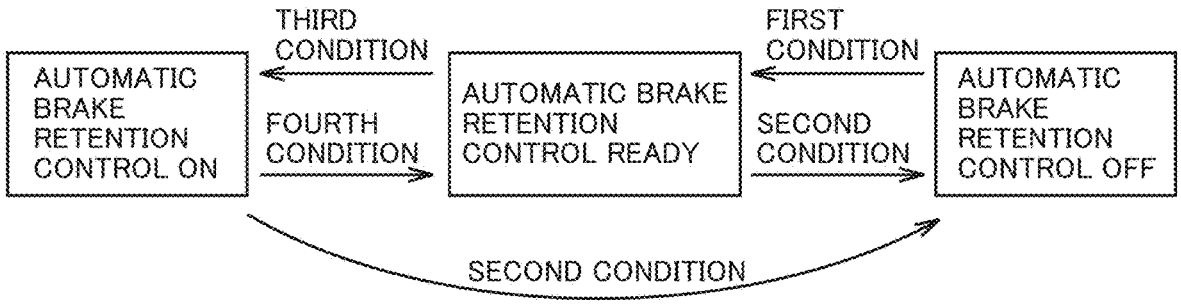
FIG. 6 is a schematic diagram showing an exemplary control logic of switching an automatic brake retention function between ON and OFF.
Figure 7:
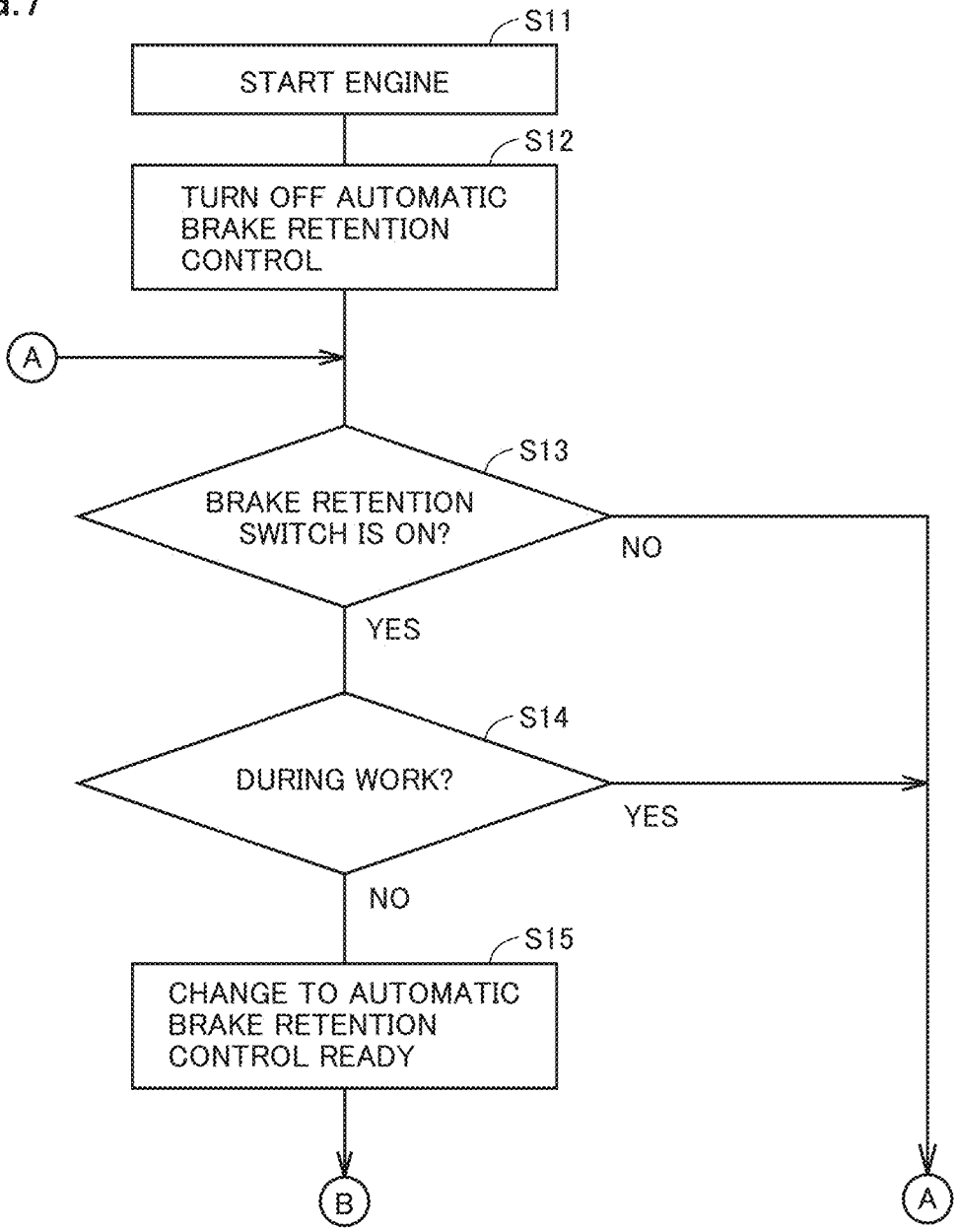
FIG. 7 is a flow diagram showing a process flow in an OFF state of automatic brake retention control.

FIG. 6 is a schematic diagram showing exemplary control logic to switch an automatic brake retention function between ON and OFF. FIG. 7 is a flow diagram showing a process flow in the OFF state of automatic brake retention control.

When engine 71 is started (step S11), the automatic brake retention control is turned OFF (step S12). While the automatic brake retention control is OFF, controller determines whether a first condition is satisfied.

The first condition is that both of the following are satisfied: brake retention switch 62 is ON, and work is not being performed by work implement 4. It can be said that the first condition being satisfied indicates the operator's intention to enable the automatic brake retention function and not to perform work with work implement 4. When brake retention switch 62 is ON (YES in step S13) and work is not being performed by work implement 4 (NO in step S14), the first condition is satisfied, and the OFF state of automatic brake retention control is changed to the READY state of automatic brake retention control (step S15).

In the determination of step S14, controller 80 may determine whether work is being performed by work implement 4 based on, for example, the state of operation of work implement lock switch 61. Specifically, since work implement 4 is locked during non-working travel of motor grader 1, controller 80 may determine that motor grader 1 is not working but is traveling when work implement lock switch 61 is turned on and work implement 4 is locked, and may determine that work is being performed when work implement lock switch 61 is turned off and work implement 4 is unlocked.

In the determination of step S14, controller 80 may determine whether work is being performed by work implement 4 based on, for example, the state of operation of the work implement operation unit (work implement levers 35L, 35R). Since the operator operates work implement levers 35L, 35R during work, when an electric signal indicating that one or more of work implement levers 35L, 35R are operated is input to controller 80, controller 80 may determine that work is being performed. A touch sensor that detects the operator touching work implement levers 35L, 35R may be provided, and when the touch sensor detects the operator touching work implement levers 35L, 35R, controller 80 may determine that work is being performed.

In the determination of step S14, controller 80 may determine whether work is being performed by work implement 4 based on the state of operation of the steering control unit in addition to the state of operation of work implement levers 35L, 35R. For example, when the operator has not operated work implement levers 35L, 35R for a certain period of time (by way of example, for 60 seconds) and an electric signal indicating that the steering control unit is being operated after a lapse of the certain period of time is input to controller 80, controller 80 may determine that work is not being performed.

When brake retention switch 62 is OFF (NO in step S13) or when work is being performed by work implement 4 (YES in step S14), the first condition is not satisfied, and the process returns to the determination of step S13, maintaining the OFF state of automatic brake retention control.

Figure 8:
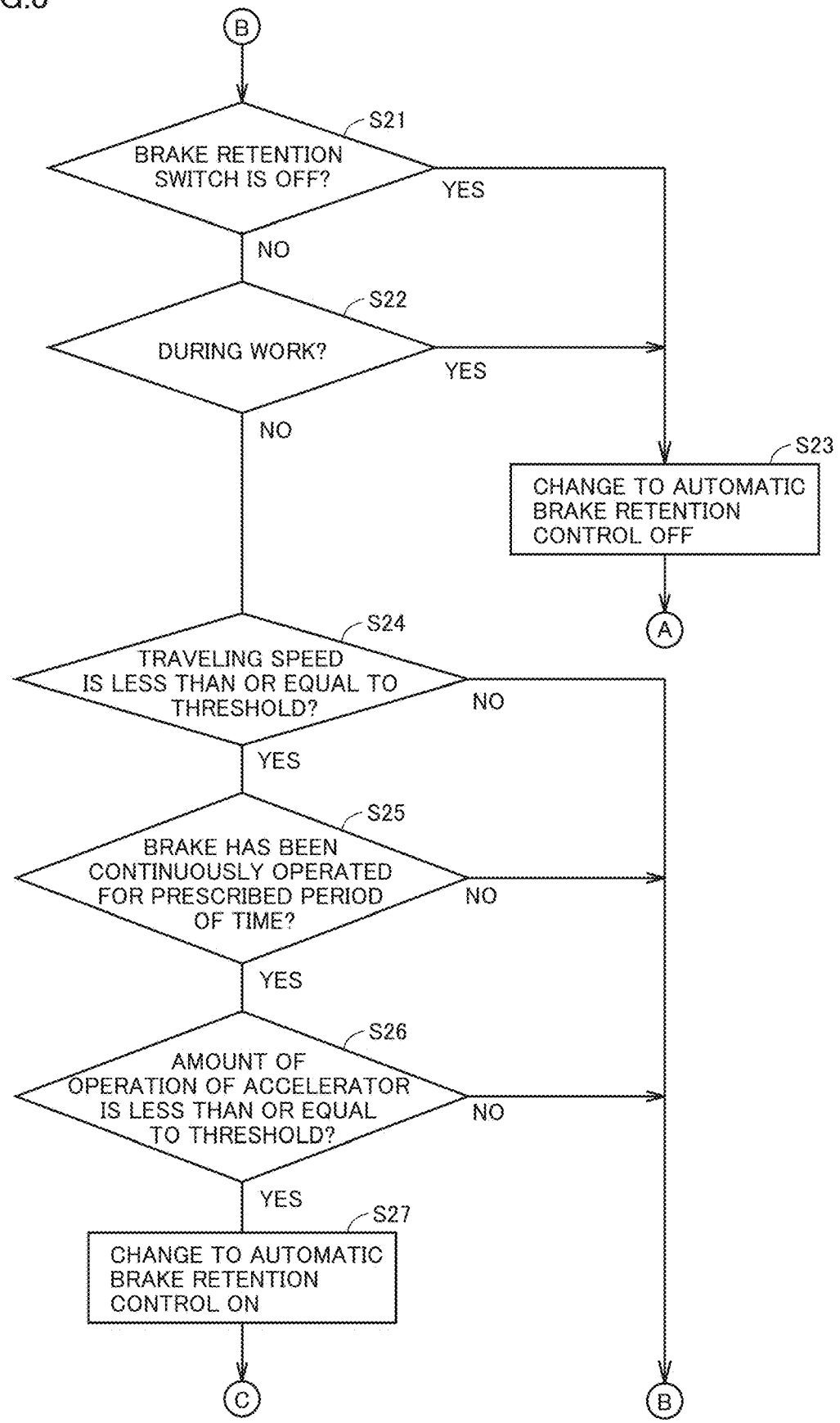
FIG. 8 is a flow diagram showing a process flow in a READY state of automatic brake retention control.

FIG. 8 is a flow diagram showing a process flow in the READY state of automatic brake retention control. The READY state of automatic brake retention control can be said as the following state: though a condition for work and a condition for brake retention switch 62 have been satisfied, control to maintain the travel-stopped state of motor grader 1 has not been performed because motor grader 1 has not stopped traveling, but control to maintain the travel-stopped state of motor grader 1 can be performed immediately after motor grader 1 stops traveling. In the READY state of automatic brake retention control, controller 80 first determines whether a second condition is satisfied.

The second condition is that any of the following is satisfied: brake retention switch 62 is OFF, and work is being performed by work implement 4. It can be said that the second condition being satisfied indicates the operator's intention to release the brake retention function by any operation of the operator. When brake retention switch 62 is OFF (YES in step S21) or work is being performed by work implement 4 (YES in step S22), the second condition is satisfied, the READY state of automatic brake retention control is changed to the OFF state of automatic brake retention control (step S23), and the automatic brake retention control is released. When it is determined that work is being performed by work implement 4, the automatic brake retention control is disabled.

When brake retention switch 62 is ON (NO in step S21) and work is not being performed by work implement 4 (NO in step S22), the second condition is not satisfied, and controller 80 then determines whether a third condition is satisfied.

The third condition is that all of the following are satisfied: motor grader 1 is determined to have stopped as the traveling speed of motor grader 1 has become less than or equal to a prescribed threshold (by way of example, 1.0 km/h), brake pedal 37 has been operated continuously for a prescribed period of time (by way of example, for three seconds) or longer, and the amount of operation of accelerator pedal 36 is less than or equal to a prescribed threshold (by way of example, 0%). It can be said that the third condition being satisfied indicates the operator's intention to stop travel of motor grader 1. The threshold of the traveling speed may be 0 km/h, and the automatic brake retention control may be ON only when motor grader 1 has come to a complete stop.

As the operator operates brake pedal 37, the traveling speed becomes less than or equal to a threshold (YES in step S24), and the operation of brake pedal 37 has been continued for a prescribed period of time (YES in step S25), and when the amount of operation of accelerator pedal 36 is less than or equal to a threshold (YES in step S26), the third condition is satisfied, and the READY state of automatic brake retention control is changed to the ON state of automatic brake retention control (step S27).

When the traveling speed is greater than the threshold (NO in step S24), the operation of brake pedal 37 has not continued for the prescribed period of time (NO in step S25), or the amount of operation of accelerator pedal 36 is greater than the threshold (NO in step S26), the third condition is not satisfied, and the process returns to the determination of step S21, thus maintaining the READY state of automatic brake retention control.

In the ON state of automatic brake retention control, controller 80 renders parking brake 78 braked or renders service brake 77 braked to retain the braking force, thereby maintaining the travel-stopped state of motor grader 1. At this time, controller 80 may change transmission 73 to neutral for improved fuel consumption and brake protection. When the speed stage setting is displayed on the monitor, even if the setting of transmission 73 is changed to neutral as a result of automatic brake retention control, the monitor may remain unchanged and still display the original speed stage setting. The braking light, which lights up as a result of the operator operating brake pedal 37, may remain lit up even if the operator takes his/her foot off brake pedal 37. The operator may be notified that the automatic brake retention function is enabled by, for example, display on the monitor.

Figure 9:
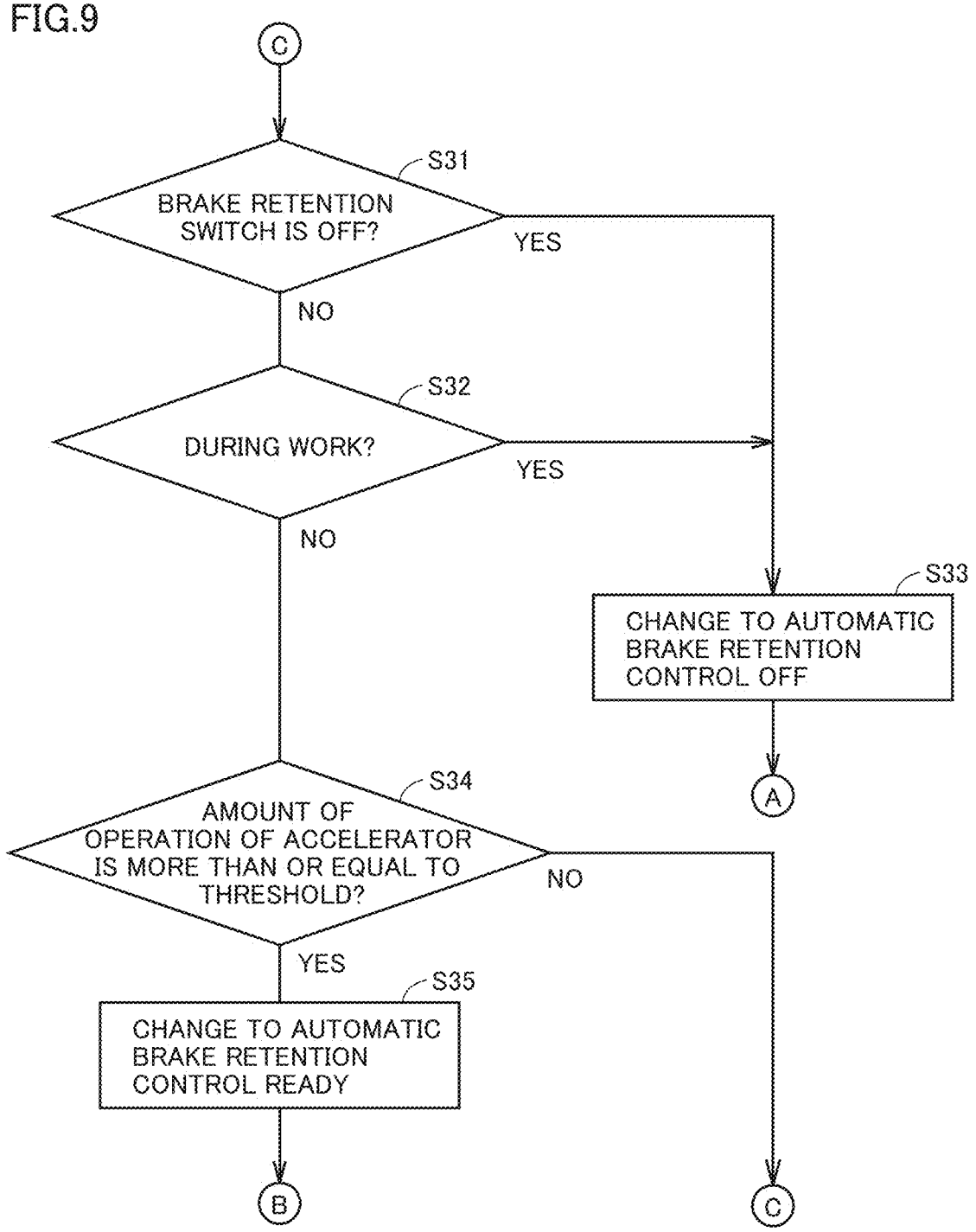
FIG. 9 is a flow diagram showing a process flow in an ON state of automatic brake retention control.

FIG. 9 is a flow diagram showing a process flow in the ON state of automatic brake retention control. In the ON state of automatic brake retention control, controller 80 first determines whether the second condition is satisfied.

When brake retention switch 62 is OFF (YES in step S31) or work is being performed by work implement 4 (YES in step S32), the second condition is satisfied, and the ON state of automatic brake retention control is changed to the OFF state of automatic brake retention control, thus releasing the automatic brake retention control. When brake retention switch 62 is ON (NO in step S31) and work is not being performed by work implement 4 (NO in step S32), the second condition is not satisfied, and controller 80 then determines whether a fourth condition is satisfied.

The fourth condition is that all of the following are satisfied: brake retention switch 62 is ON, work is not being performed by work implement 4, and the amount of operation of accelerator pedal 36 is more than or equal to a prescribed threshold. It can be said that the fourth condition being satisfied indicates the operator's intention to cause motor grader 1 to travel with automatic brake retention function enabled. Of the three conditions included in the fourth condition, the condition that work is not being performed by work implement 4 and the condition that brake retention switch 62 is ON are also included in the first condition.

It has already been determined that brake retention switch 62 is ON and work is not being performed by work implement 4 in the determination that the second condition is not satisfied. Further, when the amount of operation of accelerator pedal 36 is more than or equal to a threshold (YES in step S34), the fourth condition is satisfied, and the ON state of automatic brake retention control is changed to the READY state of automatic brake retention control (step S35). In other words, as the operator operates accelerator pedal 36, the retention of the braking force is released, allowing motor grader 1 to travel.

When controller 80 has changed transmission 73 to neutral in step S27, controller 80 returns transmission 73 to the original speed stage setting as the fourth condition is satisfied to change automatic brake retention control to the READY state.

When the amount of operation of accelerator pedal 36 is smaller than the threshold (NO in step S34), the fourth condition is not satisfied, and the process returns to the determination of step S31, thus maintaining the ON state of automatic brake retention control.

Characteristic features and functions and effects of the present embodiment will be summarized as below, although some description may overlap with the description above.

As shown in FIG. 5, controller 80 includes brake control unit 82 and disabling unit 84. Brake control unit 82 performs automatic brake retention control to retain a braking force to maintain the travel-stopped state of motor grader 1 when the traveling speed of motor grader 1 becomes less than or equal to the threshold by operation of operating brake pedal 37, and release the retention of the braking force by operation of operating accelerator pedal 36. As shown in FIGS. 6 to 9, disabling unit 84 determines whether motor grader 1 is being worked by work implement 4, and when work is being performed, disables the automatic brake retention control.

Applying automatic brake retention control to motor grader 1 can alleviate fatigue of the operator operating motor grader 1. When motor grader 1 is working, automatic brake retention control is disabled, so that work of motor grader 1 during travel at slow speed is not hindered. Operability of motor grader 1 can thus be improved.

As shown in FIGS. 3 and 5, motor grader 1 further includes work implement lock switch 61 that restricts an operation of work implement 4. Controller 80 may determine whether motor grader 1 is being worked by work implement 4, based on the state of operation of work implement lock switch 61. Since work implement 4 is locked during non-working travel of motor grader 1, motor grader 1 may be determined to not being working but being traveling when work implement lock switch 61 is ON and work implement 4 is locked, and motor grader 1 may be determined to be working when work implement lock switch 61 is OFF and work implement 4 is unlocked. This allows accurate determination whether motor grader 1 is being worked by work implement 4.

As shown in FIGS. 3 and 5, motor grader 1 further includes work implement levers 35L, 35R for the operator to operate work implement 4. Controller 80 may determine whether motor grader 1 is being worked by work implement 4 based on the state of operation of work implement levers 35L, 35R. Since the operator operates work implement levers 35L, 35R during work, when it is detected that the operator is operating work implement levers 35L, 35R or the operator is touching work implement levers 35L, 35R, it may be determined that work is being performed. This allows accurate determination whether motor grader 1 is being worked by work implement 4.

As shown in FIGS. 3 and 5, motor grader 1 further includes the steering control unit for the operator to control the direction of travel of motor grader 1. Controller 80 may determine whether motor grader 1 is being worked by work implement 4 based on the state of operation of the steering control unit. For example, controller 80 may determine that work is being performed when the frequency of operation of steering wheel 34 during a prescribed period falls far below the frequency of operation of steering control lever 5. Alternatively, when it is determined that the operator is not operating work implement levers 35L, 35R and steering wheel 34 is being operated, controller 80 may determine that work is not being performed but non-working traveling is being performed. This allows accurate determination whether motor grader 1 is being worked by working implement 4.

As shown in FIGS. 3 and 5, motor grader 1 further includes brake retention switch 62 operated to select a setting to enable automatic brake retention control. As shown in FIG. 9, controller 80 determines whether motor grader 1 is being worked by work implement 4 while the setting to enable automatic brake retention control is set by operation of brake retention switch 62, and when determining that work is not being performed, performs automatic brake retention control. This allows the use of the automatic brake retention function without affecting the work of motor grader 1.

The above embodiment has described the example in which brake retention switch 62 is provided that is operated by the operator to select whether to enable or disable the automatic brake retention function. In place of brake retention switch 62, any other means may be applied, for example, to allow selection whether to enable or disable the automatic brake retention function by operating a monitor which is a touch panel.

The embodiment has described the example in which work implement levers 35R are electric levers. The operation lever for the operator to operate work implement 4 may be a hydraulic lever. In this case, the state of operation of the lever can be determined as the pressure sensor detects that oil pressure changes as the lever is operated. It may be determined whether work is being performed by work implement 4 based on the result of the determination.

The embodiment has described the example in which the power transmission device for transmitting a driving force from engine 71 to rear wheel 12 includes mechanical transmission 73. The power transmission device may include a hydraulic static transmission (HST) that generates a pressure oil by driving the hydraulic pump with engine 71 and generates again a rotational force as the oil pressure motor is driven by the pressure oil discharged from the hydraulic pump.

Motor grader 1 is not limited to a rear-wheel-drive vehicle and may be an all-wheel-drive vehicle. In this case, the power transmission device from engine 71 to rear wheel 12 may include mechanical transmission 73 or may include the HST. The power transmission device from engine 71 to front wheel 11 may include the HST.

The embodiment has described motor grader 1 as an example of the work machine. However, the present disclosure is not limited to motor grader 1 and is also applicable to any other type of work machine that works while traveling, such as a wheel loader. Further, the idea of the embodiment may be applied to other drive systems such as diesel electric vehicles that drive a power generator by an engine, rechargeable battery electric vehicles (BEVs), and fuel cell drive vehicles (FCVs).

It should be understood that the embodiment disclosed herein is illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 motor grader; 3 cab; 4 work implement; 5 steering control lever; 11 front wheel; 12 rear wheel; 12L left rear wheel; 12R right rear wheel; 30 floor surface; 31 operator's seat; 32F, 32L, 32R console; 34 steering wheel; 35L, 35R work implement lever; 36 accelerator pedal; 37 brake pedal; 40 draw bar; 41 swing circle; 42 blade; 44, 45 lift cylinder; 46 draw bar shift cylinder; 48 tilt cylinder; 49 swing motor; 54 articulation cylinder; 61 work implement lock switch; 62 brake retention switch; 63 parking brake switch; 71 engine; 72 torque converter; 73 transmission; 74 final reduction gear; 75L, 75R tandem device; 76L, 76R rotation speed sensor; 76V speed sensor; 77 service brake; 78 parking brake; 79 engine speed sensor; 80 controller; 82 brake control unit; 84 disabling unit; 90 notification unit.

The invention claimed is:

1. A work machine comprising:

a vehicular body that travels;

a work implement supported on the vehicular body;

an accelerator operation device operated to increase a traveling speed of the vehicular body;

a brake operation device operated to decrease the traveling speed of the vehicular body; and a controller, the work machine performing work by the work implement while the vehicular body travels, wherein the controller performs automatic brake retention control to retain a braking force to maintain a travel-stopped state of the vehicular body when the traveling speed of the vehicular body becomes less than or equal to a threshold by operation of the brake operation device, and release the retention of the braking force by operation of the accelerator operation device, and determines whether the work machine is performing work by the work implement while the vehicular body travels, and when the work machine is performing work by the work implement while the vehicular body travels, disables the automatic brake retention control.

2. The work machine according to claim 1, further comprising a work implement lock device that restricts an operation of the work implement, wherein the controller determines whether work is being performed based on a state of operation of the work implement lock device.

3. The work machine according to claim 1, further comprising a work implement operation unit for an operator to operate the work implement, wherein the controller determines whether work is being performed based on a state of operation of the work implement operation unit.

4. The work machine according to claim 3, further comprising a steering control unit for the operator to control a direction of travel of the vehicular body, wherein the controller determines whether work is being performed based on a state of operation of the steering control unit.

5. The work machine according to claim 1, further comprising a switch operated to select a setting for enabling the automatic brake retention control, wherein the controller performs the automatic brake retention control when determining that work is not being performed by the work implement while the setting for enabling the automatic brake retention control is set by operation of the switch.

6. A controller for a work machine, the work machine including:

a vehicular body that travels;

a work implement supported on the vehicular body;

an accelerator operation device operated to increase a traveling speed of the vehicular body; and a brake operation device operated to decrease the traveling speed of the vehicular body, the work machine performing work by the work implement while the vehicular body travels, wherein the controller performs automatic brake retention control to retain a braking force to maintain a travel-stopped state of the vehicular body when the traveling speed of the vehicular body becomes less than or equal to a threshold by operation of the brake operation device, and release the retention of the braking force by operation of the accelerator operation device, and determines whether the work machine is performing work by the work implement while the vehicular body travels, and when the work machine is performing work by the work implement while the vehicular body travels, disables the automatic brake retention control.

7. A method of controlling a work machine, the work machine including:

a vehicular body that travels;

a work implement supported on the vehicular body;

an accelerator operation device operated to increase a traveling speed of the vehicular body; and a brake operation device operated to decrease the traveling speed of the vehicular body, the work machine performing work by the work implement while the vehicular body travels, the method comprising:

performing automatic brake retention control to retain a braking force to maintain a travel-stopped state of the vehicular body when the traveling speed of the vehicular body becomes less than or equal to a threshold by operation of the brake operation device, and release the retention of the braking force by operation of the accelerator operation device; and determining whether the work machine is performing work by the work implement while the vehicular body travels, and when the work machine is performing work by the work implement while the vehicular body travels, disabling the automatic brake retention control.

* * * * *